United States Patent [19]

Peters et al.

[11] 4,287,140

[45] Sep. 1, 1981

[54] METHOD FOR ORIENTATION AND DEPOSITION OF LIGNOCELLULOSIC MATERIAL IN THE MANUFACTURE OF PRESSED COMMINUTED PRODUCTS HAVING DIRECTIONAL PROPERTIES

[75] Inventors: Thomas E. Peters; John M. Bateman, both of Boise, Id.

[73] Assignee: Morrison-Knudsen Forest Products Company, Inc., Boise, Id.

[21] Appl. No.: 106,686

[22] Filed: Dec. 26, 1979

[51] Int. Cl.[3] ..... B06B 6/60

[52] U.S. Cl. ..... 264/23; 264/24; 264/69

[58] Field of Search ..... 264/24, 23, 69, 70

[56] References Cited

U.S. PATENT DOCUMENTS

| | | | |
|---|---|---|---|
| 2,466,906 | 4/1949 | Miller | 264/24 |
| 3,024,150 | 3/1962 | Urbanetti | 264/70 |
| 4,111,294 | 9/1978 | Carpenter | 264/24 |
| 4,113,812 | 9/1978 | Talbott et al. | 264/24 |

*Primary Examiner*—Donald E. Czaja
*Assistant Examiner*—James R. Hall
*Attorney, Agent, or Firm*—Seed, Berry, Vernon & Baynham

[57] ABSTRACT

A continuous method and apparatus are disclosed for forming and electrostatically orienting a mat of discrete particles of lignocellulosic material on an electrically nonconductive transfer surface and then transferring the directionally oriented mat onto a grounded, moving, electrically conductive mat receiving surface under the continuing influence of an electrostatic field without loss of orientation of the particles of lignocellulosic material making up the mat.

36 Claims, 8 Drawing Figures

METHOD FOR ORIENTATION AND DEPOSITION OF LIGNOCELLULOSIC MATERIAL IN THE MANUFACTURE OF PRESSED COMMINUTED PRODUCTS HAVING DIRECTIONAL PROPERTIES

BACKGROUND OF THE INVENTION

1. Field of the Invention

This invention relates to methods for the formation of a mat of directionally oriented particles of lignocellulosic material prior to pressing of such a mat to form reconstituted pressed comminuted products.

2. Prior Art Relating to the Disclosure

Directionally oriented products of reconstituted lignocellulosic materials are desirable from the standpoint of using such reconstituted products for structural purposes. Previously, uses of such reconstituted products were limited largely to those where structural considerations were not necessary, as in floor underlayment and furniture cores.

The structural properties of consolidated lignocellulosic material products made from directionally oriented fibers or flakes are conveniently measured in terms of their "orientation index" or O.I., which is simply a numerical quantity indicating the degree of preferential alignment of the lignocellulosic material making up the product. The "orientation index" is defined as the modulus of elasticity in the oriented direction (X) divided by the modulus of elasticity in the cross oriented direction (Y) or:

$$O.I = MOE_X/MOE_Y$$

The orientation index of a reconstituted lignocellulosic material product is dependent on a number of factors, including the type of lignocellulosic material from which it is made, the density of the pressed product and the method of orientation.

The production of directionally oriented products from lignocellulosic materials such as wood fiber, flakes and/or particles using mechanical orientation of the lignocellulosic material prior to consolidation of the mat of fibers is known, and equipment for doing so is commercially available. Recently a considerable amount of research has been carried out to develop a commercially feasible method and system for electrostatically orienting discrete pieces of lignocellulosic material during formation of a mat of such material and prior to consolidation of the mat under heat and pressure.

U.S. Pat. Nos. 3,843,756 and 3,954,364 describe a method and apparatus for electrostatically orienting discrete pieces of lignocellulosic material, both on a batch and continuous basis. Products produced by the continuous process described in the above patents have not been commercially acceptable due to distortion of electrostatic lines of force in the orienting zone between the spaced charged plates immediately above the mat support surface on which the oriented fibers are deposited. This distortion of the lines of force causes the pieces of lignocellulosic material, earlier directionally oriented by the electric field established between the spaced electrodes plates, to realign themselves with the distorted directional electric field existing immediately above the mat support surface.

Methods to improve the orientation index in the production of directionally oriented mats of pieces of lignocellulosic material are described in U.S. Pat. Nos. 4,111,294 and 4,113,812. U.S. Pat. No. 4,111,294 describes the use of flexible, controlled resistive material secured to the lower ends of each of the spaced planar electrodes and extending to a region adjacent the mat being formed to maintain the lines of force of the directional electric field substantially horizontal from the top of the spaced electrode plates to a region adjacent the mat being formed. U.S. Pat. No. 4,113,812 utilizes means to force an electrical current to flow within the mat being formed to provide a directionally electric field immediately above the mat being formed parallel to the direction of movement of the mat support surface and the directional electric field in the orienting zone formed between the spaced planar electrodes above the mat support surface. Various means are described in the patent for causing an electrical current to flow within the mat between the spaced electrodes such as (1) electrodes which contact the top surface of the mat at uniformly spaced intervals, (2) electrodes on the mat support surface contacting the bottom surface of the mat, and (3) electrically conductive finger electrodes secured to the mat support and extending upwardly into the mat and downwardly through the mat support surface.

German patent publication (Offenlegungsschrift) No. 2,405,995 describes a process and apparatus for aligning fiber material in the production of compression-molded parts. The fibers in the mold are subjected to vibratory motion directed transversely of the load lines in the molded piece or held in suspension by an air stream so that the fibers are aligned in the direction of the load lines. Simultaneously the fibers are also subjected to an electrostatic field whose lines of force are aligned parallel to the load lines of the molded piece.

Swedish patent publication (Utlaggningsschrift) No. 400 223 describes a batch process of overcoming the problem of distortion of the electrostatic lines of force by using spaced electrode plates having fingers on their lower ends which project down into the mat of electrostatically oriented fibers being deposited. The electrode plates are raised as the thickness of the mat of fibers being deposited increases to prevent formation of localized weak points in the formed mat.

SUMMARY OF THE INVENTION

As used herein, "particles" of lignocellulosic material is intended to include discrete pieces of lignocellulosic material such as flakes, strands, wafers, chips, shavings, slivers, fibers, etc. which are produced by cutting, hammermilling, grinding, etc.

It is a primary object of this invention to provide methods for forming an oriented, continuous mat of lignocellulosic material utilizing an electrical field for orientation of discrete pieces or particles of lignocellulosic material.

It is a further object of this invention to provide a method for transferring a mat of directionally aligned particles of lignocellulosic material from a transfer surface to a grounded, electrically conductive mat receiving surface under the continued influence of an electrostatic field without loss of orientation of the aligned particles making up the mat.

It is a further object of this invention to provide a method wherein an insulative transfer surface is located immediately beneath an orientation zone to receive directionally aligned discrete particles of lignocellulosic material descending through an orienting zone, the mat of aligned particles of lignocellulosic material deposited on the transfer surface being suspended within a directional electric field immediately above the transfer surface and parallel to the directional electric field of the orienting zone to maintain the orientation of the particles during transfer of the mat onto a moving, electrically-conductive, horizontal mat receiving surface maintained at ground potential.

It is a further object of this invention to provide a method for orientation of discrete particles of lignocellulosic material wherein the voltage gradients between the spaced electrode of the orienting zone and between the transfer section and grounded mat-receiving surface are maintained substantially equal to maintain the alignment of the particles during transfer to the mat receiving surface.

These and other objects are accomplished by depositing a mat of particles onto an electrically insulative transfer surface, subjecting the particles on the transfer surface to a directionally oriented electrostatic field to align the particles in the direction of the established electrostatic field and transferring the mat of aligned particles to an electrically conductive mat-receiving surface maintained at ground potential.

In one embodiment the particles are cascaded through a first directional electrical field which is electrically isolated from the transfer surface on which the aligned particles are deposited as a mat. The transfer surface is positioned beneath the orienting zone to receive the aligned particles descending through the first directional electrical field thereon. The aligned particles are then discharged from the transfer surface onto a mat receiving surface maintained at ground potential under the continuing influence of a second directional electric field generated immediately above and along the length of the transfer surface. The discrete particles deposited on the transfer surface may be suspended above the transfer surface for transfer to the grounded mat receiving surface under the continued influence of the second directional electric field so that during transfer, the orientation of the discrete particles is maintained and improved. The aligned mat is caused to move along the transfer surface to the discharge end thereof where it is received on a moving electrically conductive mat receiving surface maintained at ground potential.

DESCRIPTION OF THE PREFERRED EMBODIMENTS

U.S. Pat. Nos. 3,843,756; 3,954,364; and 4,113,812 to Talbott et al and U.S. Pat. No. 4,111,294 to Carpenter et al, all previously mentioned, are based on the free-fall of discrete pieces of lignocellulosic material through an established electrostatic field to achieve orientation. The principal problem encountered in the free-fall method of orientation as described in the above patents is in maintaining the uniformity of the directional electrical field in the region between the top of the mat being formed on the mat support surface and the bottom edges of the spaced planar electrode plates. Distortion of the electrical field in this region results in disorientation of a large number of the oriented particles.

The method described herein is directed to the directional orientation of discrete particles of lignocellulosic material such as flakes, strands, chips, wafers, shavings, slivers, fibers, etc. Because the electrical properties of the lignocellulosic materials vary greatly with the moisture content of the material, best results are obtained with lignocellulosic materials having a moisture content of between 4% and 20% by weight, on an oven dry basis. Although the preferred lignocellulosic material used in the process is wood, other lignocellulosic materials such as straw, grass, bagasse and other fibrous materials may be used, depending upon their availability and the type of finished product obtained.

The methods described herein transfer a mat of oriented particles of lignocellulosic material resting on an electrically insulative transfer surface to an electrically conductive mat-receiving surface at ground potential by means of a moving, endless, electrically insulative belt or by suspension of the mat on the transfer surface, the mat on the transfer surface maintained under the influence of a directional electric field to align and maintain alignment of the particles during transfer of the mat. The particles may be suspended by pneumatic means, mechanical vibration, sonic energy, fluidization, etc.

Before orientation, the particles of lignocellulosic material are metered, distributed and separated into discrete particles. The particles are then fed into distribution means for evenly distributing the particles for orientation.

The particles may be initially oriented by freefall through spaced plate electrodes onto electrically nondonductive transfer surfaces positioned beneath the spaced plate electrodes or oriented, after deposition on the transfer surface, under the influence of an established directional electric field. The directionally oriented mat resting on the transfer surface is then transferred to an electrically conductive mat-receiving surface at ground potential under the continued influence of the directional electric field.

Figure 1:
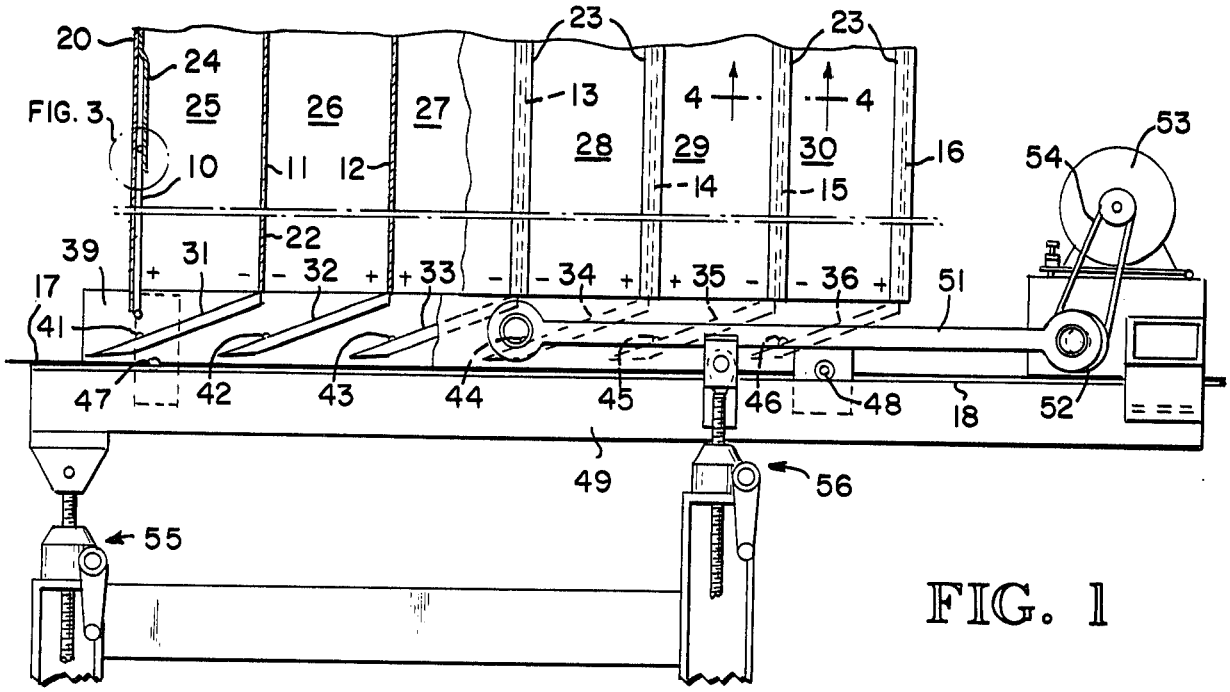
FIG. 1 is a side view in elevation of an apparatus for the continuous manufacture of an aligned mat of lignocellulosic materials used in the manufacture of reconstituted, comminuted lignocellulosic products in accordance with this invention, the apparatus imparting vibratory motion to a series of transfer surfaces to align mats of directionally oriented particles of lignocellulosic material resting on the transfer surfaces.
Figure 2:
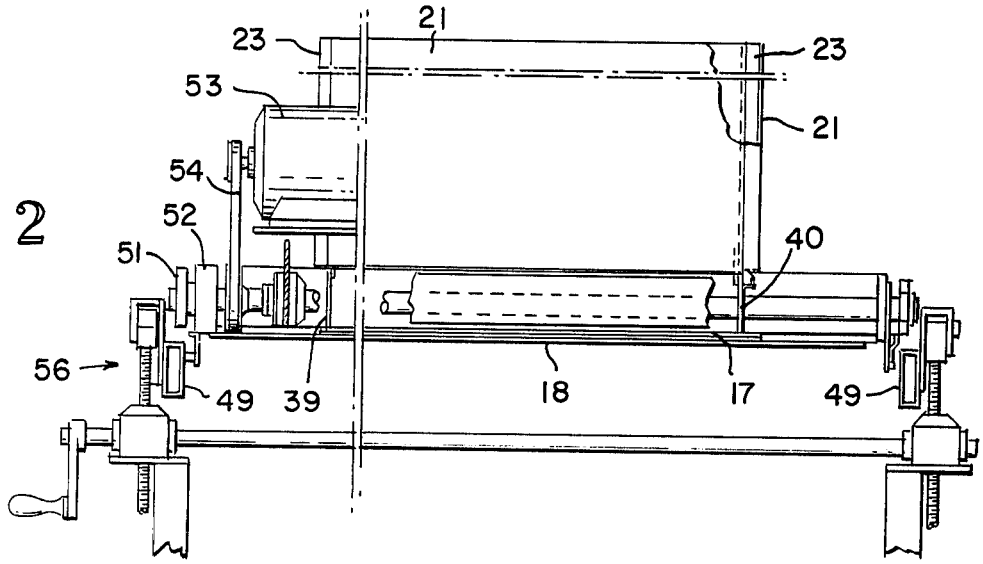
FIG. 2 is a rear view in elevation of the apparatus of FIG. 1.

In accordance with the embodiment of FIG. 1, the particles of lignocellulosic material free-fall through respective orienting cells formed between the spaced electrode plates onto respective, electrically insulative transfer surfaces positioned immediately beneath each of the orientation cells. The mats formed on the respective transfer surfaces are then transferred onto an electrically conductive, moving mat receiving surface or caul plate maintained at ground potential under the influence of an electrostatic field established along the length of each of the transfer surfaces and between the transfer surfaces and the mat receiving surface. The voltage gradient between the respective spaced electrode plates and that along the respective transfer surfaces and between the transfer surfaces and the grounded mat-receiving surface or caul plate may deviate substantially but are preferably maintained maintained substantially equal. The moving mat-receiving surface or caul plate transfers the aligned mat to a press where it is subjected to heat and pressure to form a comminuted pressed product of the desired density. The magnitude of the voltage gradient between the spaced electrode plates and that along the transfer surface and between the transfer surface and grounded mat-receiving surface may vary depending on numerous factors, including the type of material, its size and shape, moisture content, etc. Voltage gradients ranging between 1 kv/in. and 12 kv/in. may be used. Preferably direct current is used, although alternating current may be used.

Figure 3:
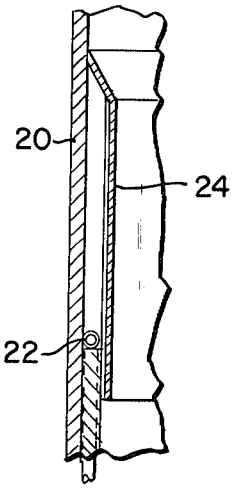
FIG. 3 is a partial vertical cross-sectional view of one of the spaced electrode plates of FIG. 1.
Figure 4:
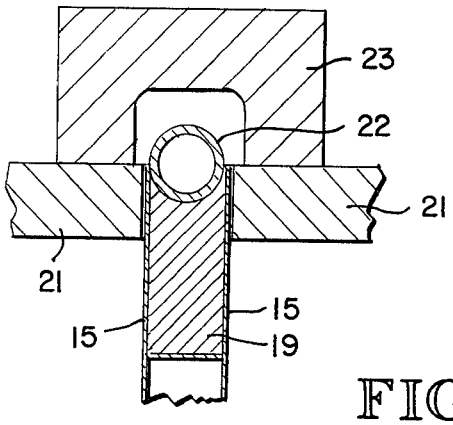
FIG. 4 is a partial horizontal cross-section along section line 4—4 of FIG. 1 illustrating the construction of the side walls of the spaced electrode plates of the orientating zone.

Referring to FIG. 1, the orientation zone is made up of a series of orientation cells defined by vertically spaced electrode plates 10, 11, 12, 13, 14, 15 and 16. The spacing of the plates is dependent on the voltage used, the size of the particles and other variables. The respective plates are oppositely charged as indicated in FIG. 1. Preferably, each of the vertical plates is mounted for vertical adjustment above a mat-receiving surface or caul plate 17 resting on the upper surface of a conveyor 18 mounted for horizontal movement beneath the series of charged electrode plates. The lower ends of each of the electrode plates adjacent the discharge ends of the respective transfer surfaces are positioned just above the respective surfaces; providing a gap between the respective electrodes and the mat of aligned particles formed on the respective transfer surfaces to enable the mats formed on each transfer surface to pass beneath its associated electrode plate. The electrode plates 10–16 are charged by a high voltage system (not shown) to develop a strong electric field between the respective electrode plates for orienting the particles as they descend by free-fall through the orientation cells. As illustrated in FIG. 4, the electrode plates 10–16 are made from spaced sheets of a suitable electrically conductive material 15, such as stainless steel, separated by a suitable insulative material 19. The outer electrode plates 10 and 16 are surrounded by a sheath 20 (see FIG. 3) of an electrically insulative material, suitably a synthetic plastic sheet material, such as polycarbonate, phenolformaldehyde, glass fiber reinforced resin, etc. The side walls 21 of the orientation zone may be made of a similar electrically insulative material. To prevent any corona discharge between the ends of the plate electrodes, the respective pairs of 10–16 are joined by tubing 22 extending around the periphery thereof (see FIG. 4). A sheath 23 of electrically insulative material for the electrode plates may be employed. A deflector plate 24 may be positioned as illustrated in FIG. 1 and in greater detail in FIG. 3, to deflect incoming particles away from the upper surface of the outer electrode plates 10 and 16 and prevent their adhering thereto.

Figure 5:
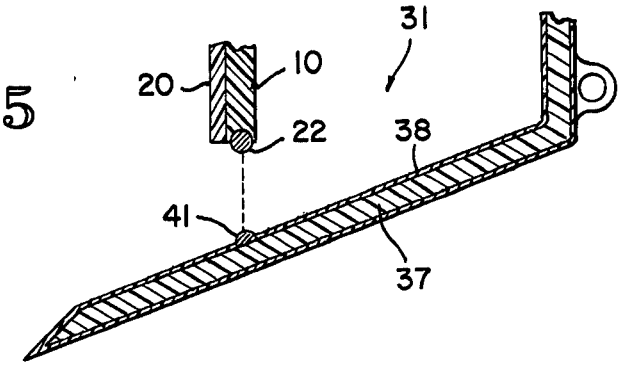
FIG. 5 is a partial vertical cross-section of one of the transfer plates of FIG. 1 illustrating the position of the electrically conductive element therein.

The incoming particles of lignocellulosic material free-fall through the respective orienting cells 25, 26, 27 28, 29 and 30 onto respective electrically insulative transfer surfaces 31, 32, 33, 34, 35 and 36 positioned immediately beneath each of the orientation cells. During free-fall through the respective orientation cells, the particles align themselves with the electrical lines of force extending between the respective oppositely charged electrode plates. The respective transfer plates may be made of any suitable electrically insulative material having a sufficiently high dielectric strength (low dielectric constant) to withstand the voltage stress encountered. As illustrated in FIG. 5, the transfer plates illustrated may have a foam core 37 of polyvinyl chloride or other suitable plastic surrounded by an overlay 38 of glass fiber reinforced resin. Each of the transfer plates 31–36 is positioned horizontally or inclined downwardly relative to a plane parallel to the mat receiving surface and in the direction of movement of the mat receiving surface 17 at an angle ranging from 0°–65°, preferably 0°–25°. The angle, if sufficiently steep, may result in the mat of particles deposited thereon sliding under the influence of gravity onto the mat receiving surface or, as illustrated in FIG. 1, the respective transfer surfaces may be subjected to vibration to cause the mats to be discharged onto the mat receiving surface. Each of the transfer surfaces 31–36 in FIG. 1, is mounted between parallel side walls 39 and 40 with the upper end of each transfer surface pivotally mounted directly beneath a respective plate electrode, except for the last plate electrode at the discharge end. Imbedded in the upper surface of each transfer surfaces 31–36 receiving the mat of aligned particles thereon are respective elongated, electrically conductive elements or electrodes 41, 42, 43, 44, 45 and 46 extending transversely to the direction of movement of the mat-receiving surface or caul plate 17 the width of the respective transfer surface and parallel to the spaced electrode plates 10–16. The respective electrodes 41–46 are preferably positioned directly beneath its associated plate electrode as illustrated in FIG. 1. Each of the electrodes 41–46 also has the same polarity as the plate electrode directly above it. The electrodes 41–46 may be in the form of narrow conductive strips, rods or any suitable configuration but are preferably rounded to minimize corona discharge. Side walls 39 and 40, supporting the transfer surfaces 31–36, rest on rods 47 and 48 extending transversely of the direction of movement of the mat-receiving surface or caul plate 17. One end of a crank 51 is connected to side plate 39 as illustrated, with the other end of the crank connected to an eccentric 52 driven by motor 53 through a belt drive 54 to impart vibratory motion to the respective transfer surfaces.

The amplitude and frequency of vibration of the respective transfer surfaces when the motor 53 is activated is adjustable and generally ranges between 1/16 inch to ⅛ inch amplitude at 800 to 1000 rpm. The height of the transfer surfaces may be adjusted vertically relative to the mat receiving surface by the vertical adjustment means 55 and vertical adjustment means 56.

The particles of lignocellulosic material freefall through the first directional electric field established in the respective orientation cells 25–30 where they are directionally aligned before being deposited on the respective transfer surfaces. The mats of aligned particles are then moved along the respective transfer surfaces onto the grounded mat-receiving surface or caul plate while under the influence of a second directional electric field established along each transfer surface between the respective electrodes 41–46 and their associated plate electrodes and between the respective electrodes 41–46 and the grounded mat receiving surface. Each of the electrodes 41–46 may be electrically connected to the plate electrode directly above it or independently charged.

Figure 7:
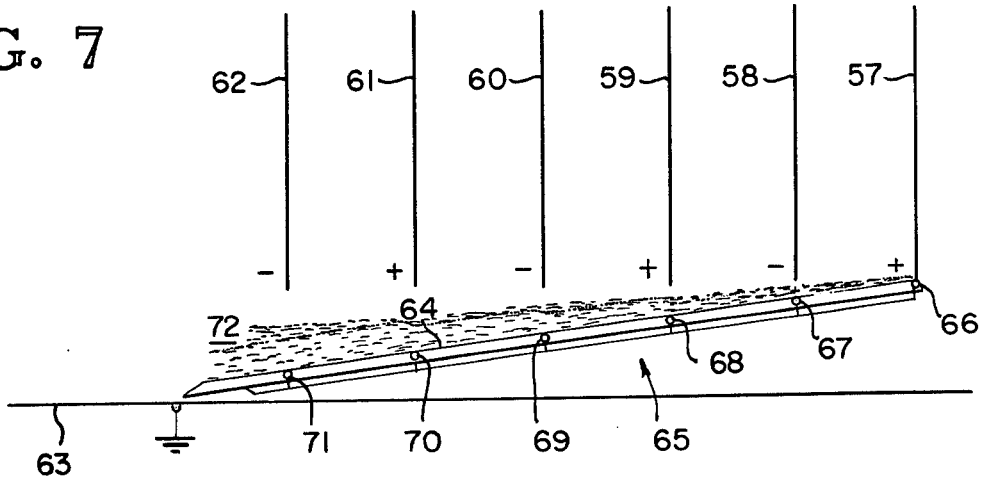
FIG. 7 is a schematic view of another embodiment for production of directionally oriented mats of lignocellulosic material wherein a rigid, electrically insulative, porous surface through which a pressurized gas is directed, is employed as the transfer surface to suspend the mat on a film of gas in the presence of a generated directional electric field for transfer of the mat to ground potential.

Rather than suspending the mat of aligned particles on the respective transfer surfaces by vibration for transfer of the mat to the caul plate at ground potential, an air film conveyor as illustrated in FIG. 7 may be used. FIG. 7 illustrates an orientation zone made up of a series of orientation cells defined by spaced electrode plates 57, 58, 59, 60, 61 and 62 which are charged as described with reference to FIG. 1. An electrically insulative member with a gas-pervious surface 64 having a width at least equal to the width of the caul plate 63 extends beneath the respective orientation cells to the grounded mat-receiving surface or caul plate. Beneath the surface 64 are a series of compartments 65 into which air or other gas is fed under pressure to provide a film of air or gas between the surface 64 and the mat of aligned particles 72 deposited on the surface after free-fall and orientation through the respective orientation cells. Electrode elements 66–71 are embedded in surface 64, preferably directly beneath each of the charged electrode plates 57–62. Each of the electrodes 66–71 has the same polarity as the charged plate directly above it. Preferably, the conveyor is inclined downwardly in the direction of movement of the electrically conductive, grounded mat-receiving surface or caul plate 63 as necessary to provide the desired feed rate of the mat of lignocellulosic particles to the grounded mat-receiving surface. The spaced plate electrodes 57–62 may be adjusted vertically as necessary to accommodate different mat thicknesses. If it is desired to maintain the voltage gradient of the electrostatic field established between each of the spaced electrode plates substantially equal to the voltage gradient between the last charged plate 62, electrode element 71 and the grounded mat-receiving surface 63, the distance between plate 62, electrode 71 and mat-receiving surface 63 should be about one-half the distance between the charged plates 57–62.

Figure 6:
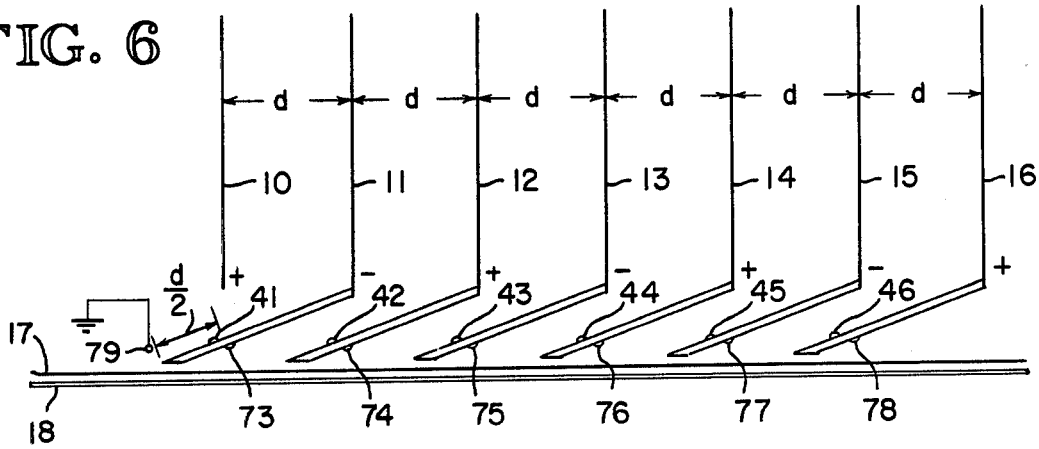
FIG. 6 is a schematic view of an embodiment for orienting discrete particles of lignocellulosic material as in FIG. 1, wherein grounded, electrically conductive electrode elements are placed on the lower surface of each of the transfer plates and a vertically adjustable grounded electrode placed adjacent the discharge end of the last electrode plate.

FIG. 6 illustrates a modified version of the embodiment of FIG. 1. The apparatus differs from that illustrated in FIG. 1 in that electrode elements 73–78, extending parallel to electrode elements 41–46, are embedded in the lower surface of each of the transfer surfaces and are grounded. The electrodes 73–78 are positioned to contact the moving mat deposited on the mat-receiving surface or caul plate 17 to aid in maintaining the field strength of the electrostatic field at those points. Likewise, a vertically adjustable grounded electrode 79 may be positioned adjacent the discharge end as illustrated to maintain the field strength of the electrostatic field between the grounded mat-receiving surface caul plate 17 and electrode element 41.

Figure 8:
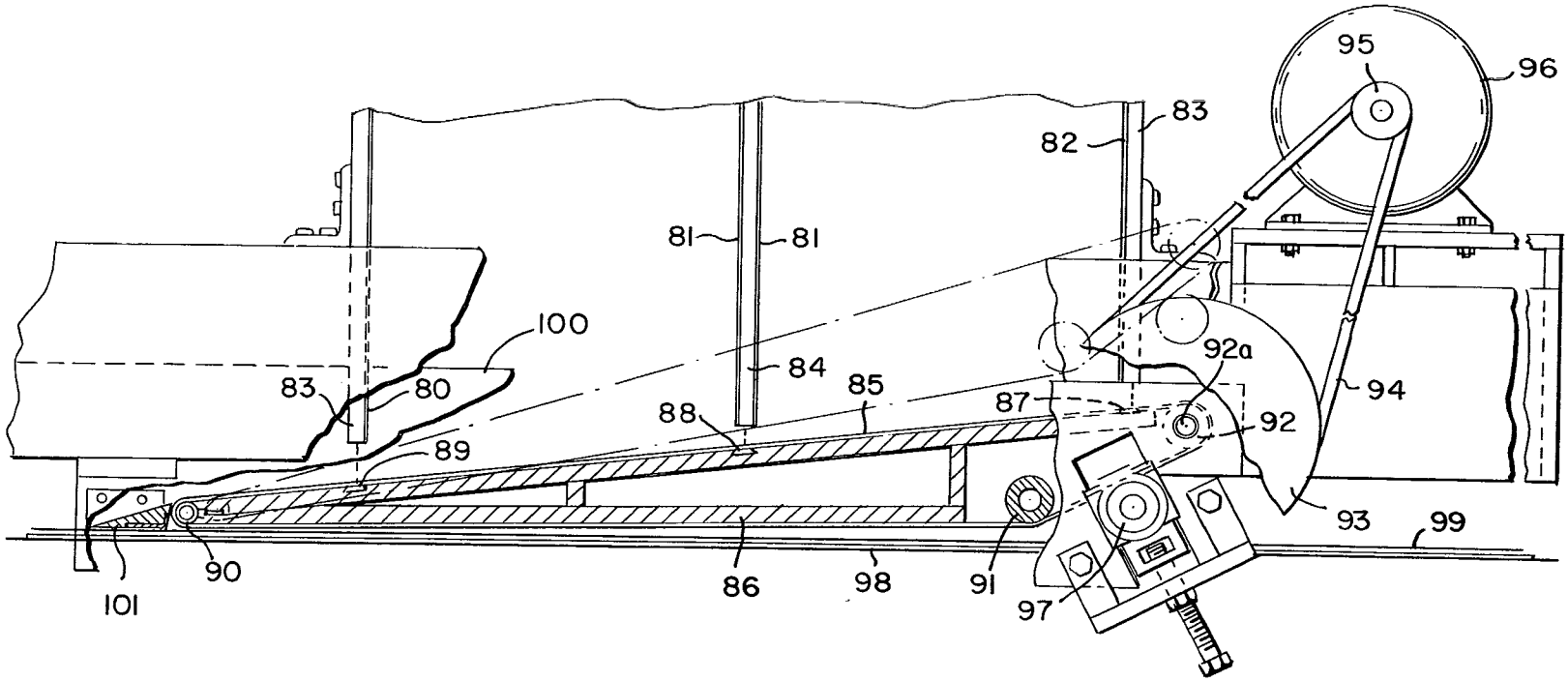
FIG. 8 is a cross-sectional view of still another embodiment of this invention for production of directionally oriented mats of lignocellulosic material wherein an electrically insulative, endless moving belt is employed as the transfer surface for transfer of a mat of oriented lignocellulosic material to a conductive mat-receiving surface maintained at ground potential under the continued influence of an electrostatic field.

FIG. 8 illustrates still another embodiment of the invention utilizing an endless electrically insulative belt as a transfer surface for transfer of the mat of oriented lignocellulosic particles to a conductive mat receiving surface maintained at ground potential. As described with reference to FIG. 1, an orientation zone, made up of a series of orientation cells, is defined by vertically spaced electrode plates 80, 81, and 82. Electrode plates 81 are separated from each other by a suitable insulating material 84. Additionally the orientation zone is sheathed with an electrically insulative material 83, as described in FIG. 1. An endless, electrically insulative belt 85 is positioned beneath the respective orientation cells. The belt may be supported by a film of air or, as illustrated, on a support member 86 which extends the length of travel of the endless belt. Imbedded in the upper surface of the support member 86 support member 86 and directly beneath each of the spaced electrode plates 80, 81, and 82 are respective electrode elements 87, 88, 89, each having the same polarity as the plate electrode directly above it. Each of the electrode elements may be electrically connected to the plate electrode directly above it, if desired. A roll bearing 90, fabricated from an electrically insulative material, is provided at the discharge end of the endless belt for travel of the endless belt thereround. The endless belt is also trained about drive roll 92 and idler roll 91 as illustrated. The drive roll, journaled on shaft **92*a* is driven by pulley 93. Pulley 93 is connected to pulley 95 by belt drive 94. Pulley 95 is connected to a suitable power means or motor 96. A take-up roll 97 may be provided to take up slack in the belt. If desired, the entire endless belt assembly and support member may be mounted for vertical adjustment relative to the plate electrodes, as illustrated in phantom. A triangular piece 101 may be provided at the discharge end of the endless belt to aid in transfer of the mat of aligned particles from the endless belt on to the grounded mat-receiving surface. An electrically conductive mat-receiving surface 99, maintained at ground potential, is supported on a conveyor 98 as illustrated, the conveyor including side plates 100**.

Although processes described in this application are with reference to orientation of the lignocellulosic particles in the direction of movement of a moving grounded mat-receiving surface it should also be noted that the particles can be oriented transverse to the direction of movement of the grounded moving mat-receiving surface, if desired.

We claim:

1. A method of aligning discrete particles of lignocellulosic material, comprising:

depositing a multitude of discrete lignocellulosic particles onto an electrically insulative transfer surface to form a mat thereof;

subjecting the particles of said mat on the transfer surface to a directionally oriented electrical field to align the particles in the direction of the established electrical field; and transferring the mat of aligned particles to an electrically conductive mat-receiving surface maintained at ground potential.

2. The method of claim 1, wherein the electrical field is generated by disposing a plurality of electrically conductive elements in spaced relationship from each other along the length of the transfer surface and establishing an electric potential in the conductive elements sufficient to generate an electrical field between each of the conductive elements and between the last conductive element and the grounded mat receiving surface.

3. The method of claim 1, wherein the mat is transferred to the mat receiving surface by suspending the particles making up the mat immediately above the transfer surface under the influence of the generated electrical field.

4. The method of claim 3 wherein the particles making up the mat are suspended by imparting a vibratory motion to the transfer surface.

5. The method of claim 3, wherein the particles making up the mat are suspended on a film of air between the transfer surface and the mat.

6. The method of claim 3, wherein the particles making up the mat are suspended by sonic energy.

7. The method of claim 1, wherein the particles making up the mat are transferred to the mat receiving surface on an electrically insulative moving belt.

8. The method of claim 1, wherein the transfer surface is inclined in the direction of movement of the mat receiving surface at an angle ranging from 0° to 65° relative to a plane extending parallel to the mat receiving surface.

9. A method of aligning discrete particles of lignocellulosic material comprising:

providing a high voltage orienting zone generating a first directional electric field of sufficient field strength to align the particles of lignocellulosic material;

cascading a multitude of particles of lignocellulosic material through the orienting zone for alignment thereof generally parallel to the electrical lines of force within the orienting zone;

providing an electrically insulative transfer surface beneath the orienting zone to receive the multitude of particles descending through the orienting zone thereon, the particles forming a mat of aligned particles on the transfer surface;

moving an electrically conductive mat receiving surface maintained at ground potential adjacent the discharge end of the transfer surface to receive the mat of aligned particles thereon, the mat receiving surface being electrically isolated from the high voltage orienting zone; and transferring the mat from on the the transfer surface to the mat receiving surface maintained at ground potential under the continuous influence of a second directional electric field established immediately above the transfer surface and parallel to the first directional field.

10. The method of claim 9 wherein the second directional electric field is generated by (1) disposing a plurality of electrically conductive elements in spaced relationship from each other along the length of the transfer surface between the beginning of the orienting zone and the grounded mat receiving surface and (2) establishing an electric potential in the conductive elements sufficient to establish an electric field between each of such elements and between the last such element and the grounded mat receiving surface.

11. The method of claim 9, wherein the mat of aligned particles is transferred to the mat receiving surface by an electrically insulative moving belt.

12. The method of claim 9, wherein the field strength of the second electric field along the length of the transfer surface to the mat receiving surface is maintained substantially equal to the field strength of the first electric field.

13. The method of claim 9, wherein the mat is transferred to the mat receiving surface by suspending the mat immediately above the transfer surface under the influence of the second electric field.

14. The method of claim 13, wherein the particles making up the mat are suspended by imparting vibratory motion to the transfer surface and the mat resting thereon.

15. The method of claim 13, wherein the particles making up the mat are suspended on a film of air between the transfer surface and the mat.

16. The method of claim 13, wherein the particles making up the mat are suspended by sonic energy.

17. The method of claim 9, wherein the particles have a moisture content of between 4 and 20 percent on an oven-dry weight basis.

18. The method of claim 9, wherein the transfer suface is inclined in the direction of movement of the mat receiving surface at an angle ranging from 0° to 65° relative to a plane extending parallel to the mat receiving surface.

19. The method of claim 9, wherein the particles include a heat curable binder in admixture therewith.

20. The method of claim 9, wherein the first directional electric field is generated by application of voltage to spaced planar electrodes positioned above and perpendicular to the mat receiving surface, the electrodes spaced in the direction of travel of the mat receiving surface.

21. The method of claim 20, wherein the second directional electric field is generated by embedding at least one elongated, electrically conductive element within the transfer surface beneath the spaced electrode adjacent the discharge end of the transfer surface, the conductive element being of the same polarity as the spaced electrode thereabove, with the longitudinal axis of the element transverse to the direction of movement of the mat receiving surface and the first directional electric field.

22. The method of claim 21, wherein the conductive element extends laterally across the transfer surface a distance at least equal to the lateral dimension of the mat being formed.

23. The method of claim 22, wherein the transfer surface is inclined in the direction of movement of the mat receiving surface at an angle relative to a plane extending parallel to the mat receiving surface sufficient to overcome friction and electrical attraction of the particles to the transfer surface.

24. The method of claim 9, including positioning an electrically conductive element maintained at ground potential on the surface of each transfer surface facing the mat receiving surface to maintain the strength of the electric field at that point.

25. The method of claim 9, including positioning a vertically adjustable, electrically conductive element maintained at ground potential above the mat receiving surface and adjacent the discharge end of the transfer surface to maintain the strength of the electrical field at that point.

26. The method of claim 21, wherein the distance between the grounded mat receiving surface and the electically conductive element adjacent the discharge end of the transfer surface, measured in the direction of movement of the mat receiving surface, is about one-half the distance between the spaced planar electrodes, measured in the direction of movement of the mat receiving surface.

27. A continuous method for orienting and depositing discrete particles of lignocellulosic material as a mat to be employed in the manufacture of comminuted pressed products having enhanced directional properties, comprising:

providing an electrically conductive mat receiving surface maintained at ground potential;

moving the mat receiving surface;

positioning a series of planar, spaced electrodes above the mat receiving surface, the electrodes spaced from each other in the direction of travel of the mat receiving surface;

generating a first directional electric field parallel to the direction of movement of the mat receiving surface between each of the spaced electrodes of sufficient field strength to align the particles of lignocellulosic material, the first electric field being electrically isolated from the grounded mat receiving surface;

cascading a multitude of particles of lignocellulosic material between the series of spaced electrodes for alignment thereof generally parallel to the generated electrical lines of force of the first electric field;

providing an electrically insulative transfer surface between and beneath adjacent pairs of the spaced electrodes to receive the multitude of particles descending between the spaced electrodes as a mat of aligned particles on the transfer surface, the transfer surface having a discharge end discharging the mat of aligned particles onto the grounded mat receiving surface; and transferring the mat on the transfer surface to the mat receiving surface under the continuous influence of a second directional electric field generated immediately above the transfer surface.

28. The method of claim 27, wherein the transfer surface is an endless, electrically insulative belt moving in the direction of the mat receiving surface along the length of the transfer surface between the first of the series of spaced electrodes and the grounded mat receiving surface, wherein a plurality of elongated, electrically conductive elements are are disposed immediately beneath the transfer surface and beneath the lower ends of each of the planar, spaced electrodes, the elements being of the same polarity as the spaced electrode above it with the longitudinal axes of the elements being tranverse to the direction of movement of the mat receiving surface; and wherein an electrical potential is established in the elements to create an electric field between each such element and between the last such element and the grounded mat receiving surface.

29. The method of claim 27, wherein the transfer surface is an electrically insulative, porous, rigid surface extending between the first of the series of spaced electrodes and the mat receiving surface; wherein a gas is provided through the porous surface at a pressure sufficient to suspend the mat of aligned particles thereon; wherein elongated, electrically conductive elements are imbedded within the porous surface beneath the lower ends of each of the spaced planar electrodes, the elements being of the same polarity as the spaced electrode above it with the longitudinal axes of the elements being transverse to the direction of movement of the mat receiving surface; and wherein an electrical potential is established in the elements to create a second electric field between each such element and between the last such element and the grounded mat receiving surface.

30. The method of claim 27, wherein the transfer surface is a series of individual transfer plates positioned beneath and between each pair of spaced, planar electrodes and the mat receiving surface; wherein vibratory motion is imparted to the individual transfer plates to suspend the respective mats of aligned particles thereon; wherein elongated, electrically nonconductive elements are embedded in the surface of each transfer surface receiving the particles thereon adjacent the respective discharge ends thereof and beneth the respective spaced planar electrodes, the elements having the same polarity as the planar electrode above it with the longitudinal axes of the elements being transverse to the direction of movement of the mat receiving surface; and wherein an electrical potential is established in the elements to create a second electric field between each such element and its adjacent planar electrode and between the last such element and the grounded mat receiving surface.

31. The method of claim 30, including positioning electrically conductive elements maintained at ground potential along the respective surfaces of each transfer surface facing the mat receiving surface to maintain the strength of the electric field at those points.

32. The method of claim 30, wherein the transfer plates are inclined downwardly in the direction of movement of the mat receiving surface at an angle ranging from 0° to 65° relative to a plane extending parallel to the mat receiving surface.

33. The method of claim 30, including positioning a vertically adjustable, electrically conductive element maintained at ground potential above the mat receiving surface and adjacent the discharge end of the last transfer surface to maintain the strength of the electrical field at that point.

34. The method of claims 2 or 10, wherein the electric potential is generated by passing an alternating current through the conductive elements.

35. The method of claims 2 or 10, wherein the electric potential is generated by passing direct current through the conductive elements.

36. The method of claim 37 wherein the transfer surface is a series of endless, electrically insulative belts positioned between respective pairs of spaced electrodes to receive the lignocellulosic particles descending therebetween, each of the belts moving in the direction of the mat-receiving surface, and wherein the second directional electrical field is generated between electrically conductive elements disposed immediately beneath each of the transfer surfaces substantially directly beneath the lower ends of the planar, spaced electrodes above each of the transfer surfaces.

* * * * *

UNITED STATES PATENT AND TRADEMARK OFFICE

CERTIFICATE OF CORRECTION

PATENT NO. : 4,287,140

DATED : September 1, 1981

INVENTOR(S) : Thomas E. Peters & John M. Bateman

It is certified that error appears in the above-identified patent and that said Letters Patent is hereby corrected as shown below:

Column 9, line 50, claim 9, delete "on the"

Signed and Sealed this

*Thirty-first* Day of *May 1983*

[SEAL]

*Attest:*

DONALD J. QUIGG

*Attesting Officer*

*Acting Commissioner of Patents and Trademarks*